US005795508A

United States Patent [19]

Soofi et al.

[11] Patent Number: 5,795,508

[45] Date of Patent: Aug. 18, 1998

[54] METHOD OF LINING A BLAST FURNACE

[75] Inventors: Madjid Soofi, St. Charles, Ill.; James S. Irwin, Hinckley, Ohio

[73] Assignee: Magneco/Metrel, Inc., Addison, Ill.

[21] Appl. No.: 650,221

[22] Filed: May 20, 1996

Related U.S. Application Data

[63] Continuation of Ser. No. 280,488, Jul. 26, 1994, abandoned, which is a continuation-in-part of Ser. No. 173,655, Dec. 27, 1993, abandoned, which is a continuation of Ser. No. 116,027, Sep. 2, 1993, abandoned, which is a continuation-in-part of Ser. No. 893,377, Jun. 4, 1992, abandoned, which is a continuation of Ser. No. 673,954, Mar. 22, 1991, abandoned.

[51] Int. Cl.[6] ..... F27D 1/16

[52] U.S. Cl. ..... 264/30; 264/34

[58] Field of Search ..... 264/30, 34

[56] References Cited

U.S. PATENT DOCUMENTS

| | | | |
|---|---|---|---|
| 1,522,064 | 9/1925 | Lake | 249/62 |
| 1,643,425 | 9/1927 | Summey | 64/317 |
| 1,656,312 | 1/1928 | Black . | |
| 1,678,976 | 7/1928 | Durfee . | |
| 1,710,931 | 1/1929 | Klein . | |
| 2,301,101 | 9/1942 | Welshans | 22/147 |
| 3,396,961 | 8/1968 | Farrington | 266/42 |
| 3,492,383 | 1/1970 | Heimgartner | 264/30 |
| 3,672,649 | 6/1972 | Allen | 263/46 |
| 3,703,348 | 11/1972 | Pivar | 425/173 |
| 3,743,187 | 7/1973 | Breunsbach | 239/489 |
| 3,832,097 | 8/1974 | Schlect | 417/516 |
| 3,885,016 | 5/1975 | Pivar | 264/269 |
| 3,916,047 | 10/1975 | Niesen | 428/35 |
| 4,078,292 | 3/1978 | Porter | 29/402 |
| 4,279,844 | 7/1981 | Danjyo et al. | 264/30 |
| 4,364,798 | 12/1982 | Costa | 202/267 R |
| 4,438,906 | 3/1984 | English | 266/44 |
| 4,442,050 | 4/1984 | Takuo | 264/30 |
| 4,469,309 | 9/1984 | Takashima et al. | 266/44 |
| 4,480,820 | 11/1984 | Zhukov et al. | 266/44 |
| 5,147,830 | 9/1992 | Banerjee et al. | 501/89 |

FOREIGN PATENT DOCUMENTS

| | | | |
|---|---|---|---|
| 116722 | 7/1942 | Australia | 264/317 |
| 0009021 | 3/1980 | European Pat. Off. . | |
| 0064863 | 11/1982 | European Pat. Off. . | |
| 0505141 | 3/1992 | European Pat. Off. . | |
| 2435532 | 2/1976 | Germany . | |
| 2512841 | 9/1976 | Germany | 264/147 |
| 2659205 | 7/1977 | Germany . | |
| 44-9646 | 5/1969 | Japan | 264/36 |
| 77-029079 | 10/1978 | Japan . | |
| 57-72758 | 5/1982 | Japan . | |
| 59-259465 | 9/1984 | Japan . | |
| 60-167843 | 5/1985 | Japan . | |
| 60-214296 | 7/1985 | Japan . | |
| 63-154258 | 12/1988 | Japan . | |
| 307712 | 10/1982 | U.S.S.R. . | |
| 1415431 | 11/1975 | United Kingdom . | |
| 1513210 | 6/1978 | United Kingdom . | |
| 2105828 | 3/1993 | United Kingdom . | |
| 85/02397 | 6/1985 | WIPO . | |

OTHER PUBLICATIONS

Spec Data: Stay-Form For Poured-In-Place Concrete, Alabama, Metal Industries Corp. (1989).

European Search Report dated Jan. 15, 1996.

*Primary Examiner*—Christopher A. Fiorilla

*Attorney, Agent, or Firm*—Brinks Hofer Gilson & Lione

[57] ABSTRACT

A method for lining a blast furnace or other metallurgical vessel in stages uses a plurality of porous consumable forms and a pumpable casting composition. A form member, including a rigid support frame and a porous consumable form mounted thereto, is installed in a lower portion of the vessel being lined, and is spaced from the vessel wall. Casting composition is then pumped into the space between the consumable form and the vessel wall, and is permitted to harden. Then, another form member is positioned above the first, and casting composition is pumped into the space between the second form member and the vessel wall. This process is repeated, using stacked form members, until the refractory lining is completely installed.

17 Claims, 6 Drawing Sheets

METHOD OF LINING A BLAST FURNACE

This application is a continuation of application Ser. No. 08/280,488, filed Jul. 26, 1994, now abandoned; which is a continuation-in part of U.S. application Ser. No. 08/173,655, filed Dec. 27, 1993, now abandoned; which is a continuation of U.S. application Ser. No. 08/116,027, filed Sep. 2, 1993 now abandoned; which is a continuation in-part of U.S. application Ser. No. 07/893,377, filed Jun. 4, 1992, now abandoned; which is a continuation of U.S. application Ser. No. 07/673,954, filed Mar. 22, 1991, now abandoned.

FIELD OF THE INVENTION

This invention relates to a method and structure for lining blast furnaces and other metallurgical vessels used in the iron and steel industry, with a refractory lining.

BACKGROUND OF THE INVENTION

Blast furnaces are used in the iron and steel industry for the production of pig iron which is later converted into steel and/or cast into a suitable form. The blast furnaces typically have refractory linings which protect their steel walls from oxidation, corrosion and erosion which would otherwise result from exposure to molten metal in the blast furnace. However, the refractory linings themselves experience wear and tear from exposure to the molten metal, and periodically have to be repaired or replaced.

The lining, or relining, of blast furnace interiors with a refractory has conventionally been a time-consuming, labor-intensive, and relatively expensive process. Conventional lining methods have involved the use of preformed refractory bricks of predetermined size and shape which are adapted to conform to the contour of the blast furnace walls when the bricks are assembled together and stacked inside the blast furnace. The bricklaying methods have evolved into a complex science involving the selection of bricks of different sizes, shapes and compositions, for different regions in a blast furnace, and for different blast furnaces. Once the proper refractory bricks have been selected and formed, the bricks are laid side-by-side, and stacked vertically, in the blast furnace, and the joints between the bricks are filled with a refractory grout or slurry which then hardens and holds the bricks together.

U.S. Pat. No. 3,672,649, issued to Allen, describes a departure from the use of conventional bricks. A plurality of molding rings are installed, in sequence, in the blast furnace at a selected distance from the blast furnace steel wall. After the first ring is installed, a refractory lining material is manually poured between the steel wall and the molding ring, or is gunned into place. Then, a molding ring is placed at the next higher level in the blast furnace, and the above process is repeated until a monolithic refractory lining completely covers the desired region inside the blast furnace.

Unfortunately, manual pouring and gunning are also very labor-intensive and require much time to complete. Although a monolithic refractory is ultimately formed, eliminating the need for preformed refractory bricks, the number of stages required to complete the manual pouring or gunning process is quite large. In the above-identified U.S. Pat. No. 3,672,649, no less than ten stages (represented by ten stacked molding rings) are shown in the drawings to form only a part of the desired monolithic refractory lining. As a result, the use of refractory bricks is still common notwithstanding the availability of this alternative process.

SUMMARY OF THE INVENTION

The present invention is a method of lining a blast furnace in stages, with a monolithic refractory lining, which requires much less time, labor and expense than prior art refractory lining methods. A refractory casting composition especially adapted for transporting using a concrete pump or other pump is provided. The pumpable casting composition eliminates the need for manual pouring and/or gunning.

A first inner form member preferably constructed from a rigid frame and a porous consumable material, is installed at the lower end of the blast furnace region which is being lined. The inner form member is positioned at a selected distance from the blast furnace shell or wall, so that the space between the form member and the shell or wall acts as a mold.

Next, the section of the blast furnace shell lateral to the form member may be lined with a thin refractory board, and the remaining space between the refractory board and form member is filled with the pumpable casting composition. The pumpable casting composition is permitted to harden and set, to form a first (lower) section of the refractory lining.

Next, a second inner form member is positioned above the first inner form member in the blast furnace. The section of the blast furnace shell adjacent the second inner form member may be lined with thin refractory board, and the remaining space between the refractory board and second inner form member is filled with the pumpable casting composition. The pumpable casting composition is permitted to harden and set, to form a second section of the refractory lining.

The above process is repeated until an entire monolithic refractory lining has been formed. One advantage of using a pumpable casting composition is that the number of required stages is dramatically reduced by the removal of manual operator constraints associated with manual pouring or gunning. Also, the use of a porous consumable form facilitates the use of larger stages because water in the refractory can be expelled through the consumable form in addition to evaporating in a vertical direction. Each single stage (represented by a single form member) can now be made taller, and can even be taller than the height of a man.

A second advantage is that the labor-intensiveness of manual pouring or gunning is reduced and simplified by the use of a pump to transport the casting composition. The result is an economical process that provides a significant time-saving, labor-saving and cost-saving incentive to steer away from the prior art use of refractory bricks, and from monolithic linings installed by manual pouring or gunning.

With the foregoing in mind, it is a feature and advantage of the invention to provide a method of installing a refractory lining in a metallurgical vessel which substantially reduces the time, labor and expense associated with prior art methods.

It is also a feature and advantage of the invention to provide a method of installing a refractory lining in a metallurgical vessel which results in the formation of a high strength, high quality, monolithic refractory lining.

The foregoing and other features and advantages of the invention will become further apparent from the following detailed description of the presently preferred embodiments, read in conjunction with the accompanying drawings. The detailed description and drawings are intended to be merely illustrative rather than limiting, the scope of the invention being defined by the appended claims and equivalents thereof.

DETAILED DESCRIPTION OF THE PRESENTLY PREFERRED EMBODIMENTS

Figure 1:
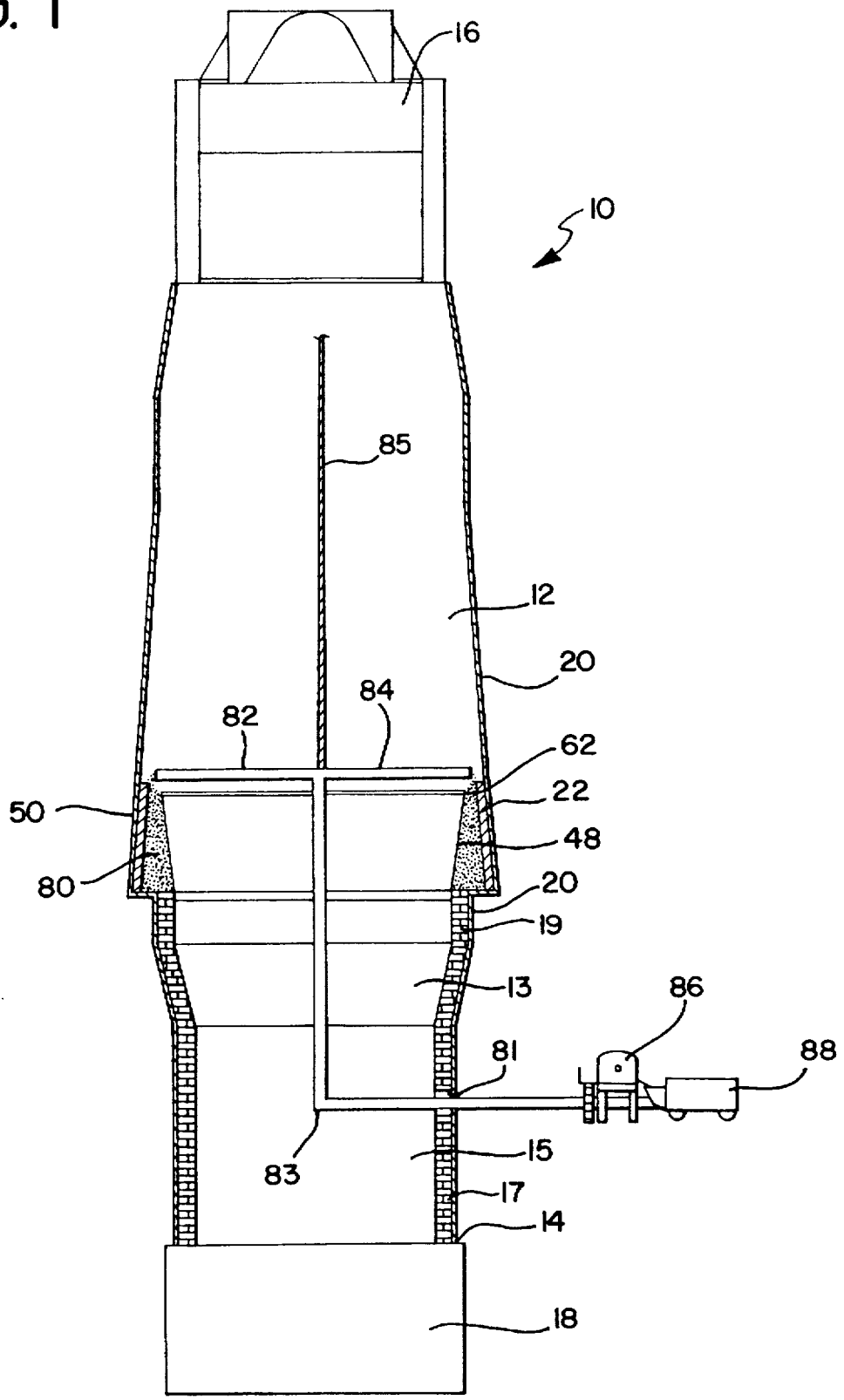
FIG. 1 is a sectional schematic view of a blast furnace during the first (lowermost) stage of formation of a refractory lining according to the method of the invention.

Referring to FIG. 1, blast furnace 10 includes a vertical stack portion 12 superimposed over a bosh portion 13 which, in turn, is superimposed over a lower hearth portion 14; and a bell or dome portion 16 above the stack. While the method of the invention can be used to line any portion of the blast furnace 10 or other metal containment device, the invention is herein illustrated with reference to the stack portion 12. Thus, in FIG. 1, the hearth portion 14 includes an upper hearth 15 which is lined with a layer 17 of conventional refractory bricks and a lower hearth 18 which typically is completely filled with conventional refractory bricks (not shown). Similarly, the bosh 13 above the hearth is lined with a layer 19 of conventional refractory bricks. The entire blast furnace 10 is also contained by an outer steel shell 20 which is adjacent to, and houses, the refractory liners.

The stack portion 12 is lined one stage at a time, in accordance with the invention. Initially, a layer 22 of refractory insulating board can be mounted against the steel shell 20 in the first (lowest) stage 50 of the stack 12. The insulating board layer 22 is optional yet preferred, because it helps contain the heat inside the blast furnace. The insulating board layer may not be needed in situations where the main refractory lining to be formed is thick enough, or possesses sufficient insulating properties, to overcome the need for a separate insulating board layer 22.

When used, the insulating board layer 22 is preferably constructed of magnesium silicate or alumina silicate board, and preferably has a thickness of about one to three inches, most preferably about two inches. One commercially available insulating board material which is suitable for use as the layer 22 is alumina silicate board, available from Pabco Company, located in Alliance, Ohio. Other conventional insulating boards may also be used. The insulating board layer 22 can be mounted against the steel shell 20 using conventional techniques, such as by applying refractory mortar to the boards and the shell, or by using fastening pins to join the boards and shell together.

After the insulating board layer 22 has been installed in the first stage 50 of the stack 12, the next step is to assemble and install a first form member 62 in the first stage 50 at a distance from the steel shell 20 and insulating board layer 22. The first form member 62, shown in detail in FIGS. 5 and 6, includes a rigid frame 30 and a cylindrical or frustro-conical porous consumable form 48 laterally adjacent the frame 30, around the frame 30, and connected to the frame 30 using plastic or metal wires or straps, or another suitable fastening mechanism (not shown).

Figure 5:
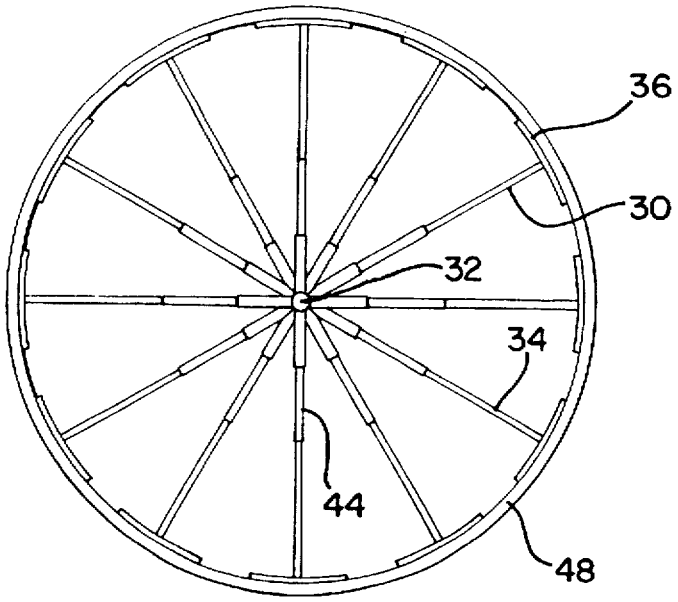
FIG. 5 is a top view of a form member used in the method of the invention.
Figure 6:
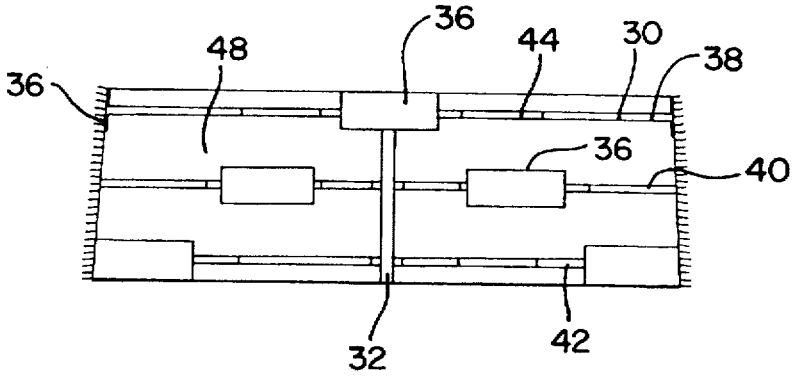
FIG. 6 is a sectional view of the form member shown in FIG. 5.

As shown in FIGS. 5 and 6, the rigid frame 30 includes an upright center pole 32, a plurality of spokes 34 projecting radially outward from the center pole 32, and a plurality of concave plates 36 at the outer ends of the spokes 34 which are used for supporting and mounting the consumable form 48. As shown in FIG. 6, the spokes 34 include upper spokes 38 projecting outward from about the top of the center pole 32, middle spokes 40 projecting outward from about the middle of the center pole 32, and lower spokes 42 projecting outward from about the bottom of the center pole 32. The spokes 34 include telescoping adjustment mechanisms 44 which are used to adjust the lengths of the spokes. By selectively adjusting the lengths of the various spokes, the form number 62 can be adjusted to wider or narrow diameters, and can be made to have a cylindrical, frustro-conical, or inverted frustro-conical configuration.

The rigid frame 30 is preferably constructed from beams and/or tubes made from steel, Re-Bar, or another rigid metal. Surrounding the rigid frame 30, in the radial direction, is the consumable form 48 which, preferably, is constructed from a consumable porous material in order to facilitate drying of the refractory lining which is being installed. The consumable porous material may be an open-mesh screen made from plastic or metal, or may be constructed from paper, plastic foam, or another material which facilitates the transmission and evaporation of moisture. One suitable porous metal screen material is sold under the name "Stay-Form" by the Alabama Metal Industries Corp. of Birmingham, Alabama.

The consumable form 48 is mounted to the rigid frame 30 at the concave plates 36. Connection of the consumable form 48 to the plates 36 may be accomplished using metal or plastic tie-wires or strap, string, glue, rivets, or any suitable fastening mechanism. The form member 62 can be constructed in situ in the blast furnace 10, or can be constructed externally and inserted into the blast furnace 10. Platforms, cables, and elevators may be temporarily provided in the blast furnace, as needed, to facilitate construction and/or installation of the first form member 62 and the other form members discussed below.

The form member 62 should be constructed and installed so that there is a space corresponding to the thickness of the refractory lining to be formed, between the outer surface of the porous consumable form 48 and the inner surface of the insulating boards 22 (if used) or the steel shell 20 (if no insulating boards are used). Next, a pumpable casting composition 80 is injected using feed pipes 82 and 84 connected via a common material hose 83 to a pump 86, from a source 88 to the space between the consumable form 48 and the insulating boards 22 or steel shell 20. The pumpable casting composition 80 is then allowed to harden and set for about 5–10 hours before the second stage of the installation is initiated. This hardening readily occurs as much of the liquid carrier (i.e., water) is transmitted (i.e. expelled or evaporated) through the porous consumable form.

Suitable pumpable refractory casting compositions are disclosed in U.S. Pat. No. 5,147,830, the contents of which are incorporated herein by reference. Generally, these pumpable compositions include about 55–90% by weight of a granular refractory base material selected from calcined clay, mullite, brown fused alumina, tubular alumina and mixtures thereof; about 8–14% by weight liquid carrier, which later serves as a binder after drying, including a dispersion of about 15–70% by weight colloidal silica in water; optionally, about 5–20% by weight calcined alumina and/or 1–35% by weight silicon carbide; and, preferably, about 0.2–1.0% by weight of a setting agent such as calcium aluminate cement or magnesium oxide, and about 1–10% by weight microsilica.

The refractory material 80 may be installed using a concrete pump or similar pump as described in U.S. Pat. No. 5,147,830. One example of a useful concrete pump is the Thom-Kat TVS16–2065, available from Pultzmeister, Inc., Thomsen Div., Gardena, Calif. 90248. Such a concrete pump is described in U.S. Pat. No. 3,382,907, and in German Patent No. 2,162,406, the disclosures of which are incorporated herein by reference.

Other commercially available concrete pumps, and other suitable pumps, can also be used to transport the casting composition 80. One presently preferred pump is the Putzmeister pump, available from Original Concrete, located in Bensenville, Illinois.

Figure 2:
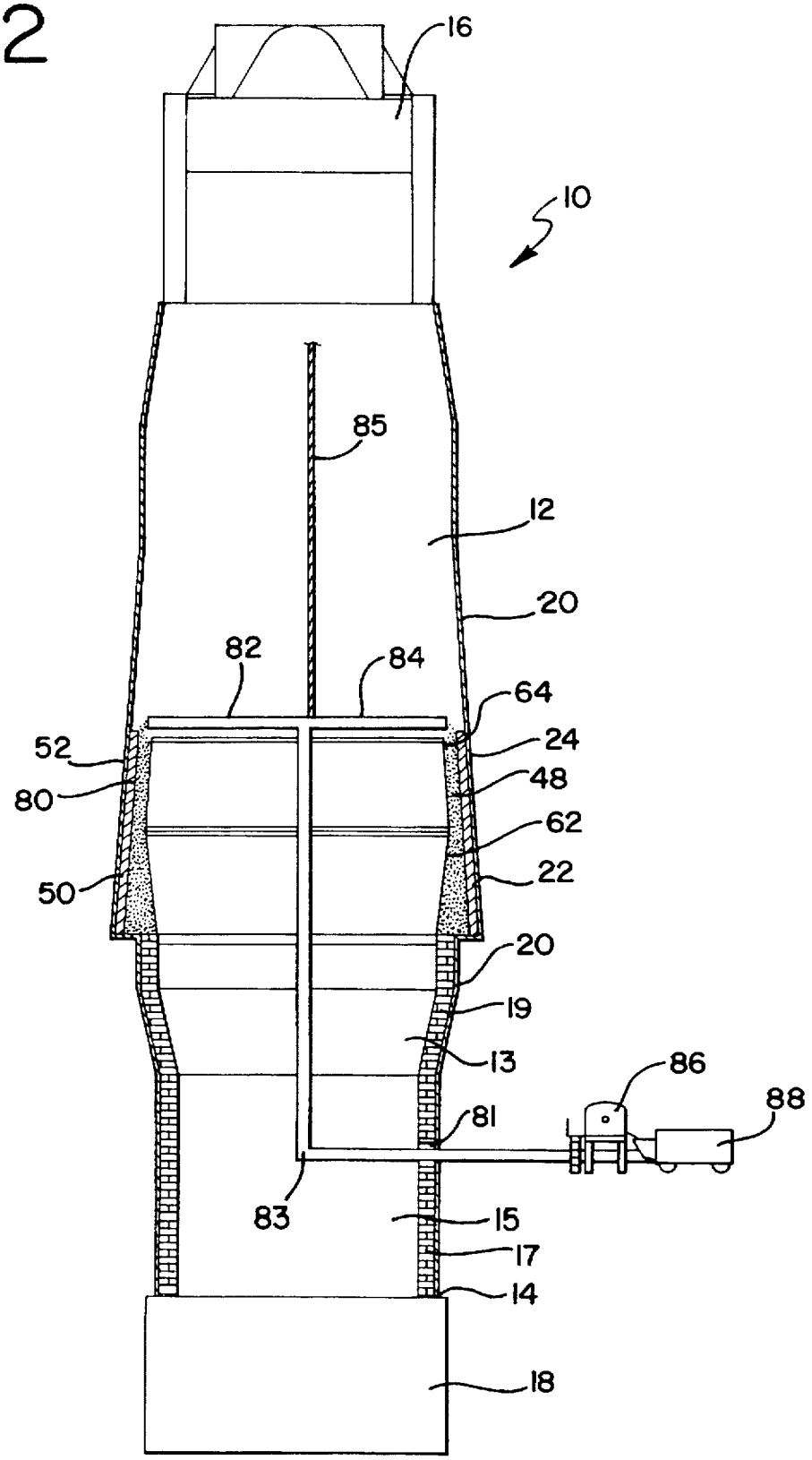
FIG. 2 shows the blast furnace of FIG. 1 during the second stage of formation of the refractory lining.

After the refractory material 80 has sufficiently hardened, a second inner form member 64 is installed above the first inner form member 62 as shown in FIG. 2, in the second stage 52 of the stack 12, at the next higher level. The second inner form member 64 may be constructed in exactly the same way as the form member 62 except for some variation in dimensions due to the changing diameter of the steel shell 20. After the second form member 64 is installed, refractory insulating boards 24 may, if used, be installed adjacent the steel shell 20 and above the insulating boards 22. Then, a further quantity of the casting composition 80 is pumped into the space between the form member 64 and the insulating boards 24 (if used) or the shell 20 (if no insulating boards are used). The refractory material 80 is again permitted to harden for about 4–10 hours, depending on the thickness of the liner, before proceeding to the third stage of the installation.

Figure 3:
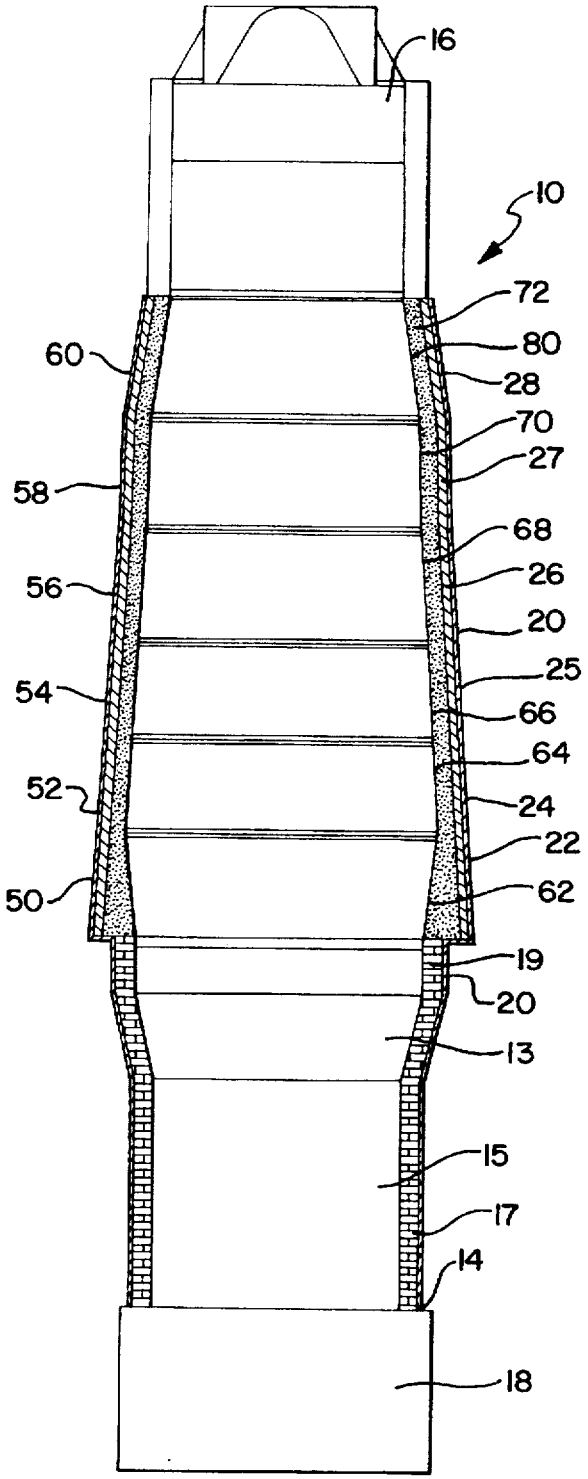
FIG. 3 shows the blast furnace of FIGS. 1 and 2 after the entire refractory lining has been formed in six stages.

The above procedure is repeated, as shown in FIG. 3, sequentially for six stages, until the entire stack 12 is lined with the pumpable refractory material 80. Form members 66, 68, 70, 72 are installed, respectively, in the third stage 54, the fourth stage 56, the fifth stage 58, and the sixth stage 60 of the installation. After each form member is installed, refractory insulating boards (26, 27, 28 or 29) may be installed in the respective stage adjacent the steel shell 20. Then, the pumpable casting composition 80 is installed between each form member and the respective insulating boards or shell 20, and is permitted to harden before the next stage of installation is commenced.

The feed pipes 82 and 84 are raised in the stack 12, as needed, for each stage of injection of the pumpable casting composition 80. This raising of the feed pipes may be accomplished, for example, by raising a hoist cable 85 connected to the feed pipes, or by mounting the feed pipes on an adjustable platform (not shown). One significant advantage of using a pumpable casting composition is that only the feed pipes 82 and 84 need to be raised, while the pump 86 and source 88 remain conveniently on the ground, and outside of the blast furnace 10. The material hose 83 that leads to the feed pipes 82 and 84 can be conveniently inserted into the blast furnace 10 through the there opening 81 located in the side, and near the bottom, of the blast furnace.

The use of a porous consumable form 48 facilitates drying and hardening of the casting composition 80 after each stage of installation. The use of a pumpable casting composition 80 eliminates the need for a labor-intensive gunning or pouring operation at each stage. These two factors, in combination, greatly simplify the formation of the refractory liner by reducing the number of stages that are required. Unlike the prior art, the height of each stage is not limited by the height of a man doing manual labor, or by the height of wet refractory composition that can be dried from the top. Instead, the only limiting factor as to the height of each stage is the inward pressure exerted by the wet casting composition on the consumable form 48 of each respective form member.

By using the method of the invention, it becomes possible to line a blast furnace stack portion having a height of 50 feet using no more than about eight stages of installation, and preferably no more than about six stages of installation. To ensure efficient practice of the method of the invention, the average height of each stage (and each corresponding form member) should be at least about six feet, preferably at least about eight feet. By using six stages of about 100 inches each, a 50-foot stack can be completely lined in less than six days total labor time. This compares to labor times of several weeks when conventional lining techniques are used.

Figure 4:
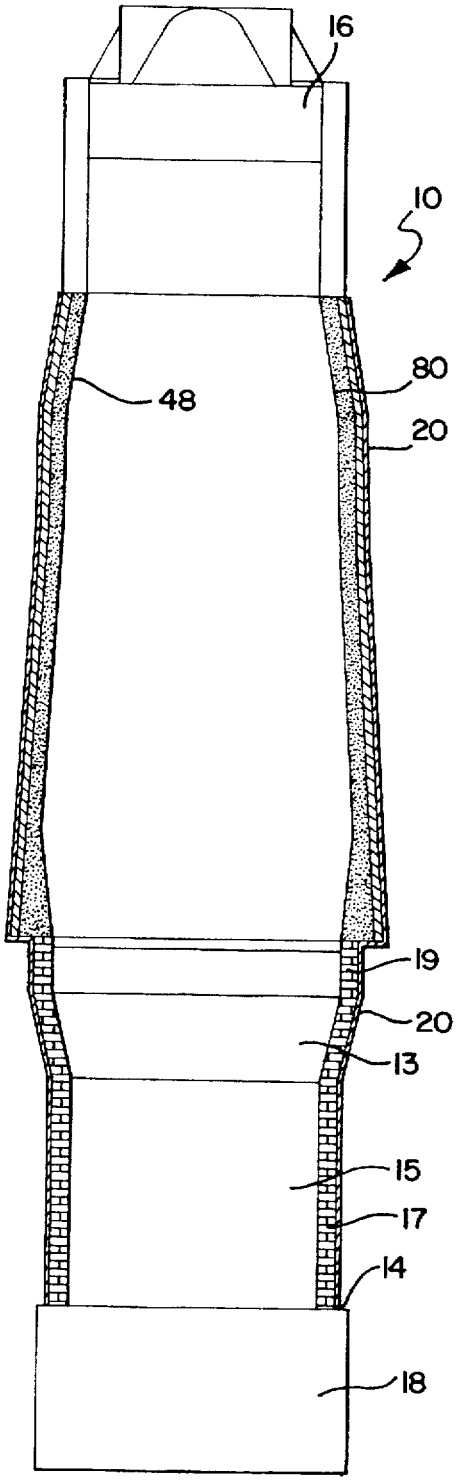
FIG. 4 shows the blast furnace of FIG. 3 after the rigid frames of the form members have been removed.

After the entire refractory lining 80 is formed and hardened, the rigid frames 30 of the form members 62, 64, 66, 68, 70 and 72 can be detached and removed, leaving only the consumable forms 48 in place as shown in FIG. 4. Then, the refractory lining 80 can be baked at an elevated temperature (above 250° F.) for about 5–30 hours, depending on its thickness, to ensure complete setting and drying. The consumable form 48 is burned off (i.e. "consumed") either during baking of the refractory lining 80 or, more likely, during subsequent exposure to molten metal when the blast furnace 10 is put to use.

FIGS. 7–12 illustrate a presently preferred method and material for constructing the consumable forms 48 for the form members 62, 64, 66, 68, 70 and 72. This method and material are described for a blast furnace having a stack portion 12 height of about 50 feet, a stack portion 12 inner diameter (after lining) of about 23–25 feet, and a stack portion 12 geometry as shown in FIGS. 1–4.

Figure 7:
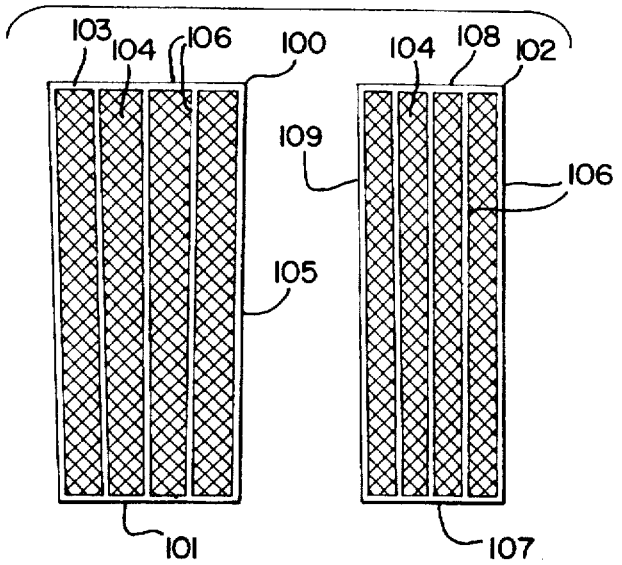
FIGS. 7–12 are front views illustrating sections which can be used to construct consumable forms for the various stages of the method of the invention.

Referring to FIG. 7, the consumable form 48 for the first (lowest) form member 62 is constructed from porous members 100 and 102, each of which is constructed from a flexible porous metal screen 104 supported by metal braces 106. The consumable porous members 100 and 102, which may be of a commercially available material known as Re-Bar, are placed edge to edge and joined together using thin metal tie wires, plastic bands, or another suitable connecting means. The first form member 102 includes nineteen sections of the "standard" porous member 100, and one section of the "key" porous member 102, joined edge to edge to provide the consumable form 48 (FIG. 5). As indicated above, the porous members 100 and 102 of the consumable form 48 may also be joined to the plates 36 of the rigid frame 30 (FIG. 5).

As shown in FIG. 7, each of the nineteen standard porous members 100 has a width of 44 inches at its smaller end 101, a width of 48 inches at its larger end 103, and a height of 102 inches along its edges 105. The key porous member 102 has a width of 35 inches at its smaller end 107, a width of 36 inches at its larger end 108, and a height of 102 inches at its edges 109. The height of 102 inches for the porous members 100 and 102 is also the height of the first stage 50 and the first inner form member 62 (FIG. 1).

The flexible porous metal screen 104 preferably has an opening size of about 0.125 inch. Generally, the screen openings should not be so small as to inhibit the transmission and evaporation of water from the refractory material 80, but should not be so large that the granular components of the refractory material 80 pass through the screen.

Figure 8:
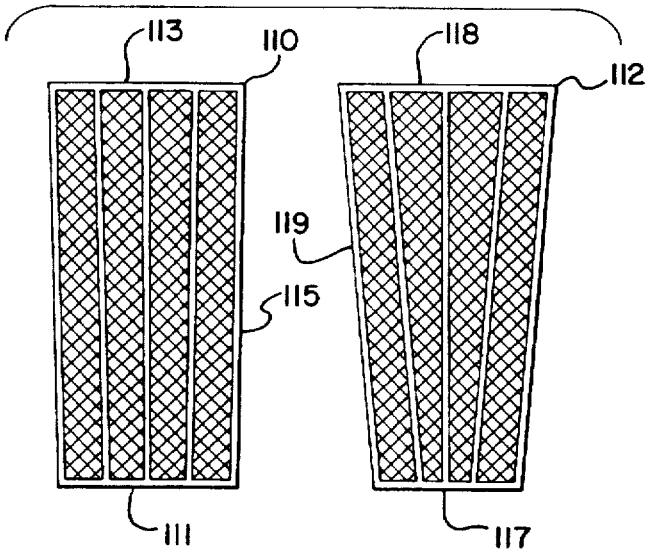

FIG. 8 illustrates the porous members 110 and 112 which can be used to construct the consumable form 48 for the second form member 64 used in the second stage 52 of the refractory lining installation (FIG. 2). The material used to construct the porous members 110 and 112 is the same as described above with respect to FIG. 7, but the dimensions are different. The consumable form 48 used in the second stage 52 includes nineteen sections of "standard" porous members 110 and one section of the "key" form member 112, aligned edge to edge and joined together. Each standard porous member 110 has a width of 45 inches at its smaller end 111, a width of 48 inches at its larger end 113, and a height of 99.75 inches along its edges 115. The key porous member 112 has a width of 36.875 inches at its smaller end 117, a width of 54 inches at its larger end 118, and a height of 99.75 inches along its edges 119.

Figure 9:
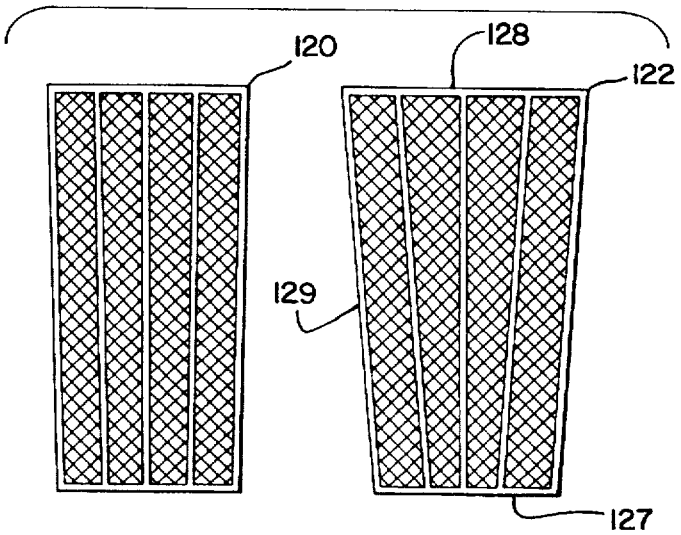

FIG. 9 illustrates the porous members 120 and 122 which can be used to construct the consumable form 48 for the third form member 66 used in the third stage 54 of the installation (FIG. 3). In FIG. 9, the standard porous member 120 is identical in every respect to the standard porous member 110 in FIG. 8. However, only eighteen sections of standard porous members 120 are used to construct the consumable form of the third form member 66. The third form member 66 also includes one key porous member 122 having a width of 45 inches at its smaller end 127, a width of 59.75 inches at its larger end 128, and a height of 99.75 inches along its edges 129.

Figure 10:
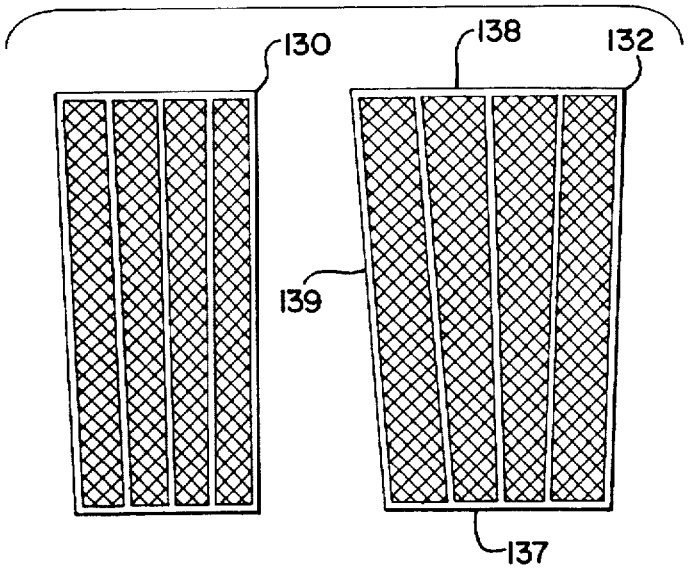

FIG. 10 illustrates the porous members 130 and 132 which can be used to construct the consumable form 48 for the fourth form member 68 used in the fourth stage 56 of the installation (FIG. 3). In FIG. 10, the standard porous member 130 is identical in every respect to the standard porous member 110 in FIG. 8. However, only seventeen sections of standard porous members 130 are used to construct the consumable form of the fourth form member 68. The consumable form of the fourth form member also includes one key porous member 132 having a width of 53.75 inches at its smaller end 137, a width of 65.5 inches at its larger end 138, and a height of 99.75 inches along its edges 139.

Figure 11:
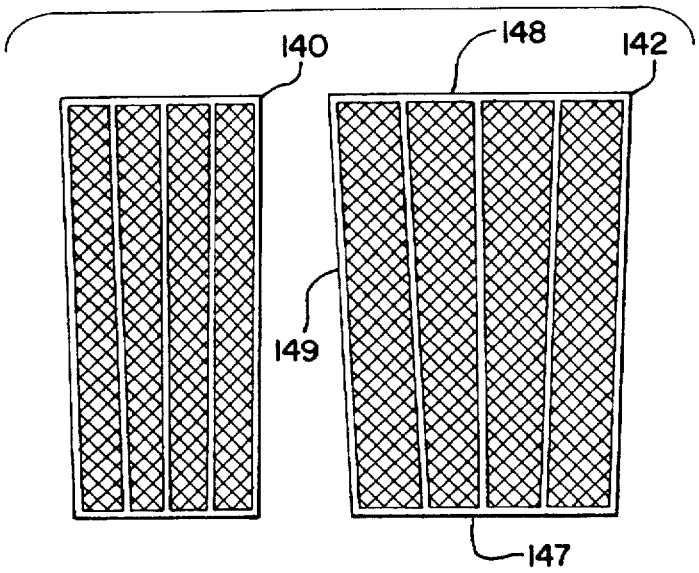

FIG. 11 illustrates the porous members 140 and 142 which can be used to construct the consumable form 48 for the fifth form member 70 used in the fifth stage 58 of the installation (FIG. 3). In FIG. 11, the standard porous member 140 is identical in every respect to the standard porous member 110 in FIG. 8. However, only sixteen sections of standard porous members 140 are used to construct the consumable form of the fifth form member 70. The fifth form member 70 also includes one key porous member 142 having a width of 62.5 inches at its smaller end 147, a width of 71.25 inches at its larger end 148, and a height of 99.75 inches along its edges 149. As with every stage of the installation, the consumable form 48 is constructed by aligning the many standard porous members and the one key porous member edge to edge and joining them together to form a complete enclosure (FIG. 5).

Figure 12:
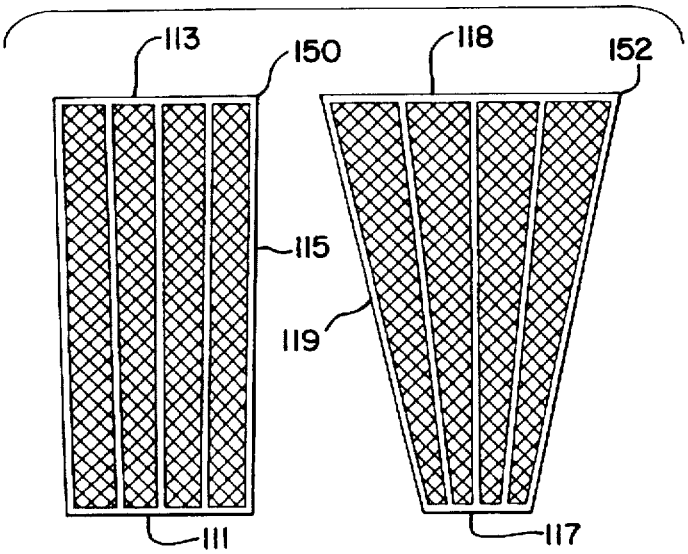

FIG. 12 illustrates the porous members 150 and 152 which can be used to construct the consumable form 48 for the sixth form member 72 used in the sixth stage 60 of the installation (FIG. 3). The consumable form 48 for the sixth stage 60 includes fifteen sections of standard porous members 150 and one section of the key porous member 152, aligned edge-to-edge and joined together. Each standard porous member 150 has a width of 45 inches at its smaller end 151, a width of 48 inches at its larger end 153, and a height of 102 inches along its edges 155. The key porous member 152 has a width of 25 inches at its smaller end 157, a width of 71.25 inches at its larger end 158, and a height of 102 inches along its edges 159.

While the embodiments of the invention disclosed herein are presently considered to be preferred, various modifications and improvements can be made without departing from the spirit and scope of the invention. The scope of the invention is indicated in the appended claims, and all charges that fall within the meaning and range of equivalents are intended to be embraced therein.

We claim:

1. A method of installing a refractory lining in a metallurgical vessel including a steel shell, comprising the steps of:

installing a first form member including a first rigid frame and, mounted to the first rigid frame, a first porous consumable form which facilitates the transmission and evaporation of liquid, in the metallurgical vessel at a distance from the shell;

pumping a casting composition which includes a granular refractory and a liquid carrier, between the steel shell and the first form member;

hardening the casting composition by transmitting at least some of the liquid carrier through the first porous consumable form;

installing a second form member including a second rigid frame and a second porous consumable form mounted to the second frame, above the first form member at a distance from the shell;

injecting a casting composition which includes a granular refractory and a liquid carrier, between the steel shell and the second form member; and hardening the casting composition by transmitting at least some of the liquid carrier through the second consumable forms;

wherein each porous consumable form has a height of at least about six feet and comprises an open-mesh screen.

2. The method of claim 1, wherein the first and second form members each have a height of at least about eight feet.

3. The method of claim 1, further comprising the step of installing a plurality of refractory insulating boards adjacent to the steel shell.

4. The method of claim 1, wherein the casting composition comprises:

about 55–90% by weight of a granular refractory base material selected from the group consisting of calcined clay, mullite, brown fused alumina, tabular alumina and mixtures thereof;

about 8–14% by weight of an aqueous colloidal silica binder;

optionally, about 5–20% by weight calcined alumina; and optionally, about 1–35% by weight silicon carbide.

5. A method of installing a refractory lining in a metallurgical vessel including a steel shell, comprising the steps of:

a) installing a form member including a rigid frame and a porous consumable form around the frame, in a lower level of the metallurgical vessel at a distance from the shell;

b) pumping a casting composition which includes a granular refractory and a liquid carrier, into a space between the form member and the shell;

c) hardening the casting composition by removing at least some of the liquid carrier;

d) installing an additional form member including a rigid frame and a porous consumable form around the frame, in a higher level of the metallurgical vessel at a distance from the shell;

e) pumping additional casting composition which includes a granular refractory and a liquid carrier, into a space between the additional form member and the shell;

f) hardening the additional casting composition by removing at least some of the liquid carrier; and g) repeating steps d)–f) until the refractory lining is completely installed;

h) wherein steps a)–c) define a first stage of installing the refractory lining, steps d)–f) define another stage of installing the refractory lining, and the installation is completed in no more than about ten stages having an average height of at least six feet per stage.

6. The method of claim 5, wherein the installation of the refractory lining is completed in no more than about eight stages.

7. The method of claim 5, wherein the stages have an average height of at least about eight feet per stage.

8. The method of claim 5, wherein the consumable form in steps a) and d) comprises a porous screen material.

9. The method of claim 8, wherein the porous screen is constructed of metal.

10. The method of claim 5, wherein the consumable form in steps a) and d) comprises paper.

11. A method of installing a refractory lining in a metallurgical vessel including a steel shell, comprising the steps of:

a) installing a form member at least about six feet in height which includes a rigid frame and a porous consumable form mounted to the frame, in the metallurgical vessel at a distance from the shell;

b) pumping a casting composition which includes a granular refractory and a liquid carrier, into a space between the form member and the shell;

c) hardening the casting composition by removing at least some of the liquid carrier through the porous consumable form; and d) repeating steps a)–c) a plurality of times until the refractory lining has been completely installed;

wherein performance of steps a)–d) is completed using not more than eight form members.

12. The method of claim 11, wherein the form member is at least about eight feet in height.

13. The method of claim 11, wherein the metallurgical vessel is a blast furnace.

14. The method of claim 13, wherein the refractory lining is installed in a stack portion of the blast furnace.

15. The method of claim 11, wherein step b) further includes the initial step of installing a refractory insulating material adjacent the shell.

16. The method of claim 11, wherein the form member is constructed external to the metallurgical vessel.

17. The method of claim 11, wherein the form member is constructed in situ in the metallurgical vessel.

* * * * *

UNITED STATES PATENT AND TRADEMARK OFFICE

CERTIFICATE OF CORRECTION

PATENT NO. : 5,795,508
DATED : August 18, 1998
INVENTOR(S) : Madjid Soofi et al.

It is certified that error appears in the above-identified patent and that said Letters Patent is hereby corrected as shown below:

On the Title Page

In column 1, line 5, under "U.S. PATENT DOCUMENTS", please change "1/1929" to --1/1928--.

In column 1, line 6, under "U.S. PATENT DOCUMENTS", please change "1/1942" to --1/1940--.

In column 2, line 11, under "FOREIGN PATENT DOCUMENTS", please change "59-259465" to --84-259465--.

In column 2, line 12, under "FOREIGN PATENT DOCUMENTS", please change "60-167843" to --85-167843--.

In column 2, line 13, under "FOREIGN PATENT DOCUMENTS", please change "60-214296" to --85-214296--.

In column 2, line 15, under "FOREIGN PATENT DOCUMENTS", please change "307712" to --307172--.

UNITED STATES PATENT AND TRADEMARK OFFICE

CERTIFICATE OF CORRECTION

PATENT NO. : 5,795,508

DATED : August 18, 1998

INVENTOR(S) : Madjid Soofi et al.

It is certified that error appears in the above-identified patent and that said Letters Patent is hereby corrected as shown below:

In claim 5, line 22, please delete "and".

In claim 5, line 24, after "installed;", please insert --and--.

Signed and Sealed this

Twelfth Day of December, 2000

*Attest:*

Q. TODD DICKINSON

*Attesting Officer*

*Director of Patents and Trademarks*